US005306173A

United States Patent [19]

Suzuki

[11] Patent Number: 5,306,173

[45] Date of Patent: Apr. 26, 1994

[54] BULB SOCKET

[75] Inventor: Takanori Suzuki, Shizuoka, Japan

[73] Assignee: Yazaki Corporation, Japan

[21] Appl. No.: 5,116

[22] Filed: Jan. 15, 1993

[30] Foreign Application Priority Data

Jan. 20, 1992 [JP] Japan ..... 4-1502[U]

[51] Int. Cl.[5] ..... H01R 4/50

[52] U.S. Cl. ..... 439/336; 439/918

[58] Field of Search ..... 439/332-336, 439/602, 649, 667, 672, 918; 313/318

[56] References Cited

U.S. PATENT DOCUMENTS

| | | | |
|---|---|---|---|
| 826,359 | 7/1906 | Romain et al. | 439/649 X |
| 1,590,016 | 6/1926 | Godley | 439/649 |
| 1,826,220 | 10/1931 | Parker | 439/649 |
| 3,668,603 | 6/1972 | Burgess et al. | 439/336 X |
| 3,805,211 | 4/1974 | Moore | 439/918 X |
| 3,810,072 | 5/1974 | Moore | 439/918 X |
| 4,804,343 | 2/1989 | Reedy | 439/336 X |

FOREIGN PATENT DOCUMENTS 50-78074 7/1975 Japan .

*Primary Examiner*—Larry I. Schwartz
*Assistant Examiner*—Khiem Nguyen
*Attorney, Agent, or Firm*—Venable, Baetjer, Howard & Civiletti

[57] ABSTRACT

A bulb socket including a center electrode contact and a side electrode contact, each having elastic contact members at the forward end thereof, and a socket body wherein a bulb insertion portion and an electrode contact housing are formed having an inclination angle. The electrode contact housing includes a center electrode contact housing chamber and a side electrode contact housing chamber inclined relative to the bulb insertion portion. Each contact housing chamber has flexible retaining members retaining engaging portions of corresponding electrode contacts. Thus, the ease of assembling the bulb socket can be improved.

5 Claims, 4 Drawing Sheets

BULB SOCKET

BACKGROUND OF THE INVENTION

1. Field of the Invention

The present invention relates to the construction of a bulb socket used in automobiles and the like.

2. Description of the Related Art

Conventional bulb sockets used for lighting of automobiles and the like are constructed as follows: a water-proof plug is fit to the bottom of the socket, and the plug has a center hole at its center within which the hole a plurality of annular projecting portions are formed, and through which a wire is passed and held. A core of the wire is soldered to a tip contact electrode provided at the center of a disk with a substantially smaller diameter than the bore of the socket. A coil spring is inserted between the disk and the water-proof plug, thereby the disk having the tip contact electrode is held elastically towards a bulb insertion portion of the socket.

Since the conventional bulb socket is constructed as above-described, the following assembly procedure must be observed; the wire having an end portion of the core thereof exposed therefrom is passed through the center hole of the water-proof plug, the coil spring is disposed around the wire, and the core at the end is soldered to the mated side of the tip contact electrode at the center of the disk. Then, the water-proof plug through which the wire is passed is fit into the bottom of the socket, and the wire is laid out of the water-proof plug. A retaining protrusion provided on the disk is engaged with an engaging recess portion of the socket while the disk compresses the coil spring. Thus, the assembly of the bulb socket is completed.

As to inserting the bulb into the socket and fixing it, the bulb is rotated with inserting the engaging protrusion provided on the side electrode contact of the bulb into an L-shaped retaining groove formed inside of the socket body, whereby the tip contact electrode of the bulb is brought into contact with the tip contact electrode of the disk as the former presses down the disk.

As will be clearly understood from the foregoing description of the related art, the assembly of the conventional bulb socket is extremely troublesome for the following reasons. After the wire is passed through the center hole of the water-proof plug, the coil spring is disposed around the wire, and the core is soldered to the tip contact electrode of the disk. The retaining protrusion is engaged with the engaging recess portion of the socket body while the disk compresses the coil spring.

SUMMARY OF THE INVENTION

It is therefore an object of the present invention to provide a bulb socket used in automobiles and the like, with an excellent operation performance of the assembly.

To this end, the present invention provides a bulb socket comprising: a center electrode contact having an elastic contact member at the forward end which contacts a center electrode of a bulb; a side electrode contact having an elastic contact member at the forward end which contacts a side electrode of the bulb; a socket body formed of synthetic resin including a bulb insertion portion and a portion of the socket through which wires are led (hereinafter referred to as a wires-led portion); the wires-led portion including a electrode contact housing of which a central axis intersects with a central axis of the bulb insertion portion at an inclination angle; the electrode contact housing including a center electrode contact housing chamber and a side electrode contact housing chamber which are formed in the plane defined by the central axis of the electrode contact housing and the central axis of the bulb insertion portion and which are formed in parallel on each side of the central axis of the electrode contact housing; the center electrode contact housing chamber and the side electrode contact housing chamber each having on its inside wall, flexible retaining members which retain engaging portions of corresponding electrode contacts; a water-proof plug formed of synthetic rubber through which a wire connected to the center electrode contact and a wire connected to the side electrode contact are passed; and a rear holder formed of the synthetic resin closing an opening of the wires-led portion of the electrode contact housing.

The inclination angle between the central axis of the bulb insertion portion and the central axis of the electrode contact housing may preferably be an obtuse angle of substantially 120 degrees.

According to the present invention, the assembly operation is completed simply by inserting the center electrode contact and the side electrode contact each remained connected to the cores of two wires into the respective electrode contact housing chambers so as to allow engaging portions of each electrode contact to be retained by flexible retaining members provided in the respective electrode contact housing chambers. Thus, the ease of assembling the bulb socket can be greatly improved.

Other objects, advantages and novel features of the present invention will be described hereinafter in detail with reference to the accompanying drawings.

DESCRIPTION OF THE PREFERRED EMBODIMENT

Figure 1:
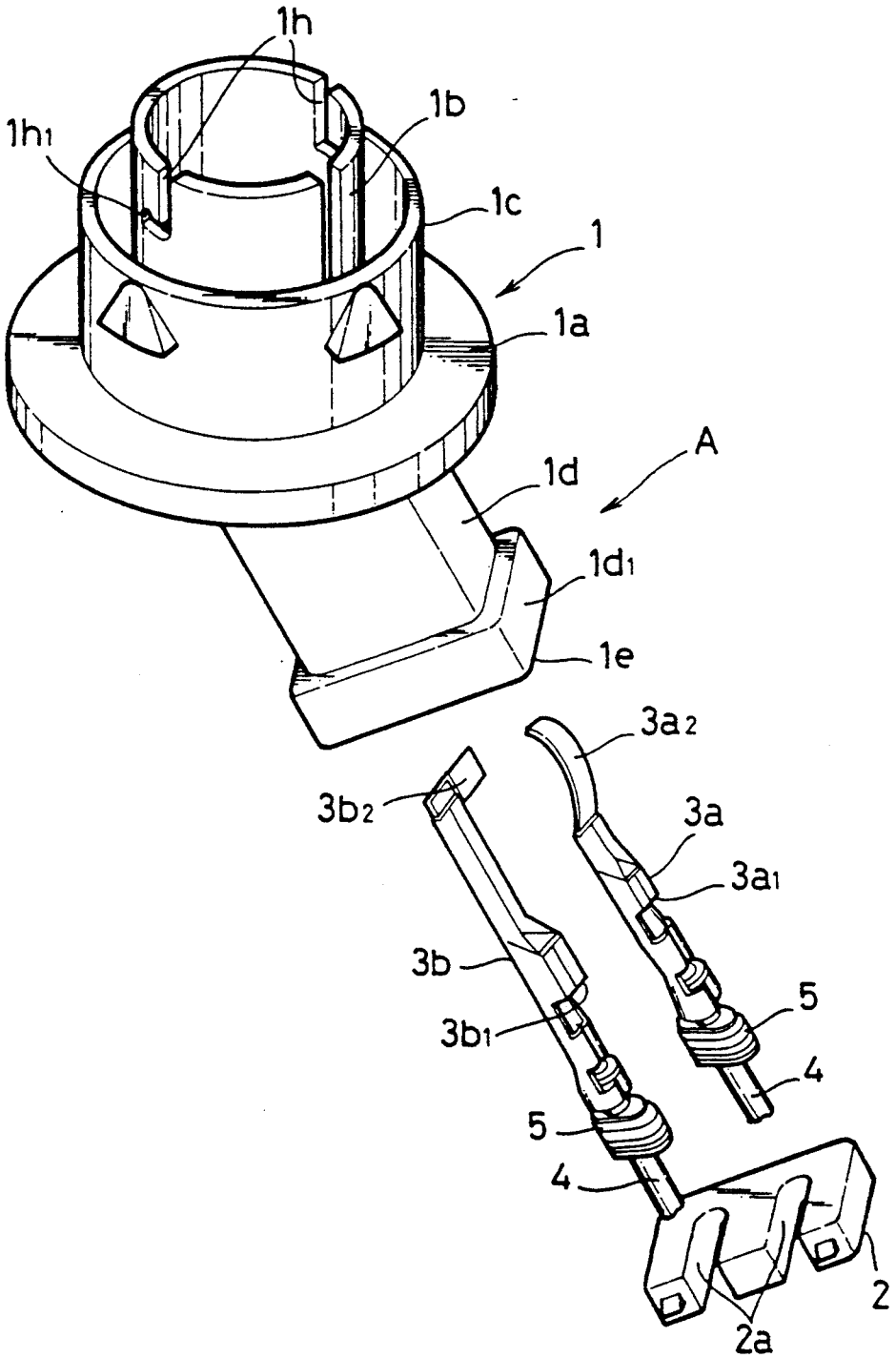
FIG. 1 is an exploded perspective view of a bulb socket according to the present invention.
Figure 2:
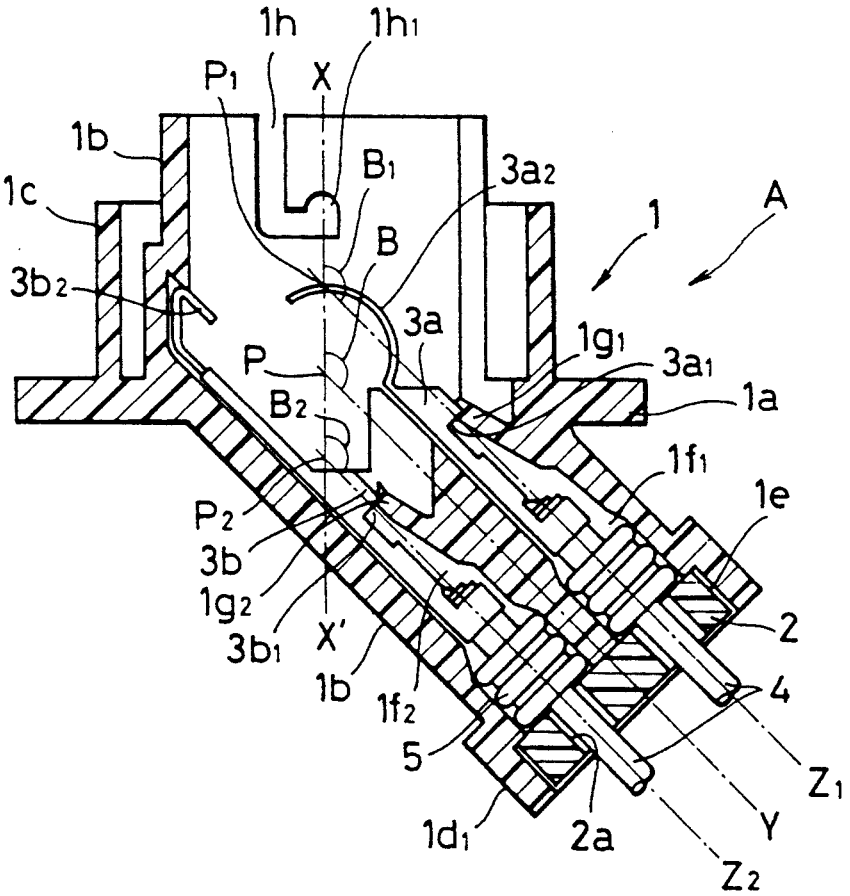
FIG. 2 is a longitudinal sectional view of the bulb socket according to the present invention.

A preferred embodiment will now be described in detail with reference to the drawings. As shown in FIG. 1, a tubular socket body 1 formed of synthetic resin which forms a flange-shaped collar 1*a* at the center thereof includes, at one end., a bulb insertion portion 1*b* extending perpendicularly from the collar 1*a*, and a protecting tube 1*c* surrounding the bulb insertion portion 1*b* up to substantially half the height thereof. As illustrated in FIGS. 1 and 2, the socket body 1 includes, at the other end, a wires-led portion 1*d* which forms an electrode contact housing and which is extended having an inclination angle with the collar 1*a*. An end portion $1d_1$ of the wire-led portion 1*d* forms a recessed portion 1*e* with a slightly larger opening, into which a rear holder 2 provided with a pair of wire insertion holes 2*a* fits. The material of the socket body 1 and the rear holder 2 is polybutylene terephthalate or nylon. A accommodates a center electrical contact 3*a* and a side electrode contact housing chamber $1f_2$ which accommodates a side electrode contact 3*b* are respectively formed in parallel within the wires-led portion 1*d*. Flexible retaining members $1g_1$ and $1g_2$ are formed near the collar la on the inside walls of the center electrode contact housing chamber $1f_1$ and the side electrode contact housing $1f_2$, respectively, thereby constructing retaining means together with an engaging portion $3a_1$ of the center electrode contact 3*a* and an engaging portion $3b_1$ of the side electrode contact 3*b*, which will be described later.

The forward end portions of a pair of wires 4 are fit into each water-proof plug 5 formed of acrylonitrile-butadiene rubber, and connected to the center electrode contact 3*a* and the side electrode contact 3*b*, respectively. An elastic contact member $3a_2$ at the forward end of the center electrode contact 3*a* formed of phoshor bronze is formed in the shape of an arc and protruding at the center of the bottom of the bulb insertion portion 1*b* of the socket body 1, as shown in FIG. 2. On the other hand, as shown in FIG. 2, an elastic contact member $3b_2$ at the forward end of the side electrode contact 3*b* formed of copper alloy is formed in the shape of a hook in longitudinal section, slightly protruding inward from the inside wall of the bulb insertion portion 1*b* of the socket body 1. Both electrode contacts 3*a* and 3*b* have metal plates in the middle thereof which are folded in a U-shape in cross-section so as to form the aforementioned engaging portions $3a_1$ and $3b_1$, respectively.

Figure 4:
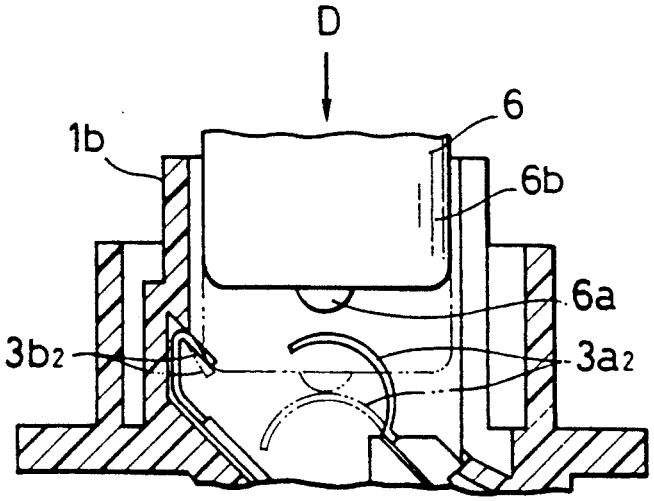
FIG. 4 is a longitudinal sectional view showing the procedure for inserting a bulb into the bulb socket according to the present invention.

As illustrated in FIG. 4, the length of the center electrode contact 3*a* from its rear end to the forward end with the elastic contact member $3a_2$ is arranged to contact a center electrode 6*a* of a bulb 6, and the length of the side electrode contact from its rear end to the forward end with the elastic contact member $3b_2$ is arranged to contact a side electrode 6*b* of the bulb 6.

As will be clearly understood from FIG. 2, the central axis X of the bulb insertion portion 1*b* of the socket body 1 intersects with the central axis Y of the wires-led portion 1*d* at the point P forming an inclination angle B. The center electrode contact housing chamber $1f_2$ and the side electrode contact housing chamber $1f_2$ are respectively formed along the surface which pass both central axes X and Y. The axis XX' extending from the central axis X of the bulb insertion portion 1*b* intersects with the central axis $Z_1$ of the center electrode contact housing chamber $1f_1$ at the point $P_1$ forming $B_1$ at the same angle as B, and also with the central axis $Z_2$ of the side electrode contact housing chamber $1f_2$ at the point $P_2$ forming $B_2$ at the same angle as B. Optimally, the inclination angle B is approximately 120 degrees.

As shown in FIGS. 1 and 2, a pair of L-shaped slits 1*h* are formed of slit portions 1*h* and self-retaining portions $1h_1$, thereby constructing retaining means together with retaining protrusions (not shown) of the bulb 6.

Figure 3:
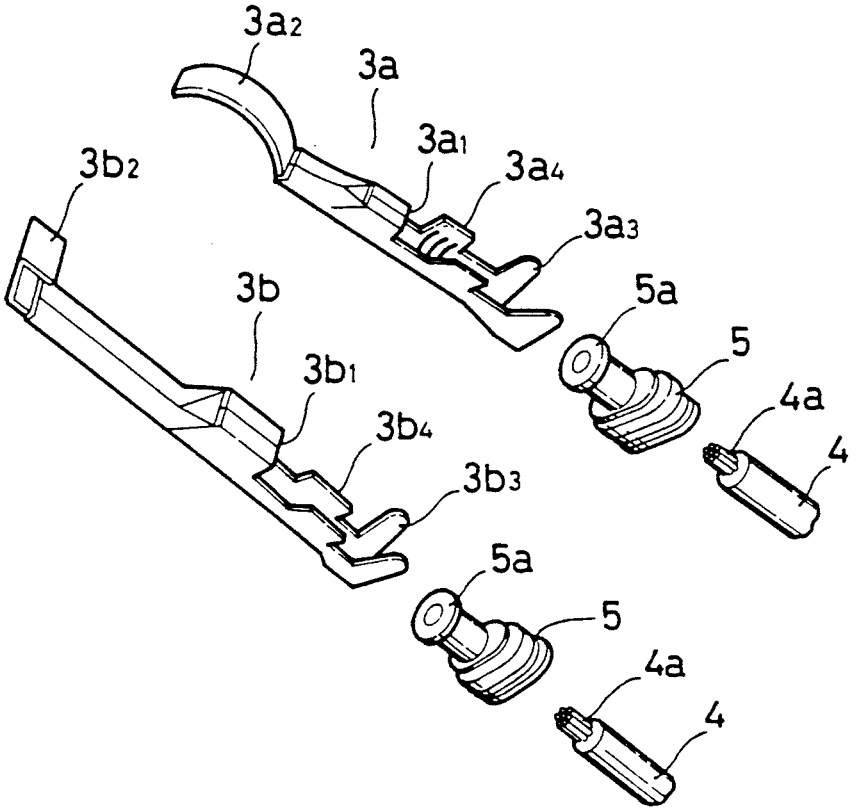
FIG. 3 is an exploded perspective view of a center electrode contact and a side electrode contact of the bulb socket.

A bulb socket A is constructed as described hereinbefore. Therefore the assembly procedures are as follows; first of all, as illustrated in FIG. 3, the wire 4 is passed through the water-proof plug 5; then a core 4*a* is fastened by a conductor fastening member $3a_4$ of the center electrode contact 3*a* and an insulator of the wire 4 is fastened by the insulator fastening member $3a_3$, thereby completing the connection. Likewise, the side electrode contact 3*b* is connected to the wire 4 in the same way.

The water-proof plug 5 is slid on the wire 4 until the forward end portion 5*a* of the water-proof plug 5 abuts against the insulator fastening member $3a_3$ of the center electrode contact 3*a* and is retained such that the engaging portion $3a_1$ of the center electrode contact 3*a* is positioned facing the flexible retaining member $1g_1$ of the center electrical contact housing chamber $1f_1$. Then, the center electrode contact 3*a* is inserted from its forward end portion into the center electrode contact housing chamber $1f_1$. When the engaging portion $3a_1$ of the center electrode contact 3*a* is retained at the edge of the flexible retaining member $1g_1$ of the housing, the the wire 4 is retained while prevented from disconnection. Likewise, the side electrode contact 3*b* connected to the wire 4 is inserted into the side electrode contact housing chamber $1f_2$, and the wire 4 is retained in the same way as applied to the center electrode contact 3*a*.

The rear end portions of the two wires 4 are passed through the insertion holes 2*a* of the rear holder 2; the rear holder 2 slides on the wire 4 and fits into the recessed portion le of the socket body 1. Thus, the assembly of the bulb socket A is completed.

As shown in FIG. 4, the bulb 6 is inserted from the center electrode 6*a* into the bulb insertion portion 1*b* of the socket body in the direction indicated by the arrow D. When the bulb 6 is inserted to the position indicated by the two-dot chain lines and rotated, the retaining protrusions of the bulb 6 are retained by the self-retaining portions $1h_1$ of the L-shaped slits 1*h* of the bulb insertion portion 1*b*, and the bulb 6 is held by the elasticity of the elastic contact member $3a_2$ of the center electrode contact. Accordingly the center electrode 6*a* of the bulb 6 electrically contacts the elastic contact member $3a_2$ and the side electrode contact 6*b* electrically contacts the elastic contact member $3b_2$, elastically deformed, of the side electrode contact 3*b*.

Figure 5:
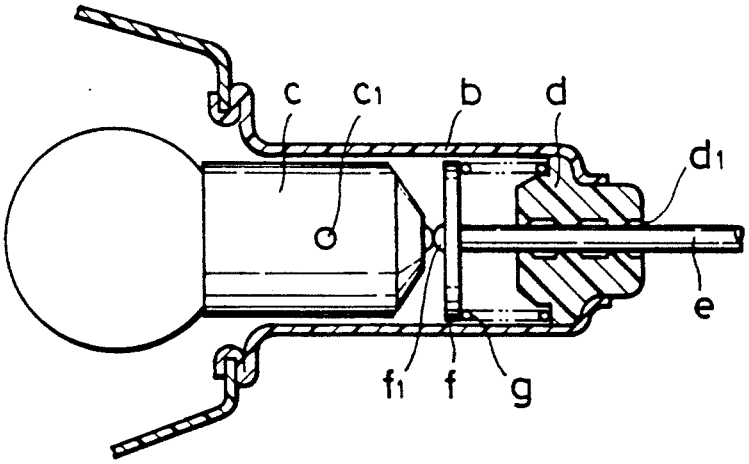
FIG. 5 PRIOR ART
FIG. 5 is a longitudinal sectional view of a bulb socket of an example of the related art.

FIG. 5 shows a conventional bulb socket, wherein a water-proof plug d is fit to the bottom of a socket body b, and a wire e is held within a center hole of the water-proof plug d inside of which hole having a plurality of annular projecting portions formed therein. A core of the wire e is soldered to the mated side of an electrode $f_1$ at the center of a disk f, and a coil spring g is inserted between the disk f and the water-proof plug d. A bulb c is inserted and rotated into the socket so as to allow a retaining protrusion $c_1$ on the side of the bulb c to engage an L-shaped retaining groove, whereby the center electrode elastically is brought into contact with a tip contact electrode $f_1$ of the disk.

Consequently, the present invention offers the following advantage.

Since the bulb socket can be assembled simply by inserting the center electrode contact and the side electrode contact into the respective contact housing chambers, the troublesome assembly procedure of the conventional bulb socket is omitted, thus greatly improving the operational performance of the assembly.

What is claimed is:

1. A bulb socket comprising:

a center electrode contact having an elastic contact portion at a forward end thereof, which is adapted to contact a center electrode of a bulb, and a conductor fastening portion for receiving a conductor;

a side electrode contact having an elastic contact portion at a forward end thereof, which is adapted to contact a side electrode of said bulb, and a conductor fastening portion for receiving a conductor; and a housing that includes a bulb insertion portion for receiving a bulb and an electrode contact portion for receiving said center electrode contact and said side electrode contact;

wherein said electrode contact portion extends from said bulb insertion portion such that a central axis of said electrode contact portion intersects a central axis of said bulb insertion portion at an inclination angle;

wherein said electrode contact portion of said housing includes a first elongated chamber for receiving said center electrode contact and a second elongated chamber for receiving said side electrode contact, said first elongated chamber having a central axis that extends in a plane that is defined by said central axis of said electrode portion and said central axis of said bulb insertion portion, and said second elongated chamber having a central axis that extends in said plane that is defined by said central axis of said electrode portion and said central axis of said bulb insertion portion; and wherein said central axes of said first and second elongated chambers are substantially parallel and located on opposing sides of said central axis of said electrode contact portion.

2. The bulb socket of claim 1, wherein said first elongated chamber of said electrode contact portion has on an inside wall thereof a flexible retaining member which retains a corresponding engaging portion provided on said center electrode contact, and said second elongated chamber of said electrode contact portion has on an inside wall thereof a flexible retaining member which retains a corresponding engaging portion provided on said side electrode contact.

3. The bulb socket of claim 1, further comprising a water-proof plug through which a conductor that is connected to said center electrode contact and a conductor that is connected to said side electrode contact may be passed.

4. The bulb socket of claim 1, further comprising a rear holder, and wherein said electrode contact portion of said housing is provided with a wire-led portion, said wire-led portion having an opening for receiving said rear holder.

5. The bulb socket of claim 1, wherein said inclination angle between said central axis of said bulb insertion portion and said electrode contact portion is approximately 120 degrees.

* * * * *